US009065215B2

(12) United States Patent
Buck et al.

(10) Patent No.: US 9,065,215 B2
(45) **Date of Patent: *Jun. 23, 2015**

(54) ELECTRICAL CONNECTOR HAVING COMMON GROUND SHIELD

(71) Applicant: FCI AMERICAS TECHNOLOGY LLC, Carson City, NV (US)

(72) Inventors: Jonathan E. Buck, Milpitas, CA (US); Stephen B. Smith, Mechanicsburg, PA (US)

(73) Assignee: FCI AMERICAS TECHNOLOGY LLC, Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,070

(22) Filed: Nov. 17, 2014

(65) Prior Publication Data

US 2015/0072558 A1 Mar. 12, 2015

Related U.S. Application Data

(63) Continuation of application No. 13/364,656, filed on Feb. 2, 2012, now Pat. No. 8,888,529.

(60) Provisional application No. 61/444,344, filed on Feb. 18, 2011.

(51) Int. Cl.

| | |
|---|---|
| ***H01R 13/6586*** | (2011.01) |
| ***H01R 13/6461*** | (2011.01) |
| ***H01R 13/6473*** | (2011.01) |

(52) U.S. Cl.

CPC ..... *H01R 13/6586* (2013.01); *H01R 13/6461* (2013.01); *H01R 13/6473* (2013.01)

(58) Field of Classification Search

CPC ..... H01R 13/65802; H01R 31/02
USPC ..... 439/607.05, 607.06, 607.07, 607.08, 439/607.09, 607.13, 607.1, 101, 108, 439/907.11

See application file for complete search history.

(56) References Cited

U.S. PATENT DOCUMENTS

| | | | | |
|---|---|---|---|---|
| 5,518,422 | A | 5/1996 | Zell et al. | |
| 5,993,259 | A | 11/1999 | Stokoe et al. | |
| 6,409,543 | B1 | 6/2002 | Astbury et al. | |
| 6,506,076 | B2 | 1/2003 | Cohen et al. | |
| 6,565,387 | B2 | 5/2003 | Cohen | |
| 6,602,095 | B2 | 8/2003 | Astbury, Jr. et al. | |
| 6,663,426 | B2 | 12/2003 | Hasircoglu et al. | |
| 6,764,349 | B2 | 7/2004 | Provencher et al. | |
| 6,971,916 | B2 | 12/2005 | Tokunaga | |
| 7,074,086 | B2 | 7/2006 | Cohen et al. | |
| 7,497,736 | B2 | 3/2009 | Minich et al. | |
| 7,651,337 | B2 | 1/2010 | McNamara | |
| 7,762,843 | B2 | 7/2010 | Minich et al. | |
| 8,267,721 | B2 | 9/2012 | Minich | |
| 8,888,529 | B2 * | 11/2014 | Buck et al. | 439/607.05 |
| 2007/0042639 | A1 | 2/2007 | Manter et al. | |
| 2007/0054554 | A1 | 3/2007 | Do et al. | |
| 2010/0240233 | A1 * | 9/2010 | Johnescu et al. | 439/108 |

* cited by examiner

*Primary Examiner* — Phuongchi T Nguyen
(74) *Attorney, Agent, or Firm* — Baker & Hostetler LLP

(57) ABSTRACT

An electrical connector assembly includes a first electrical connector and a second electrical connector that can be mated so as to establish an electrical connection across the electrical connectors at a mating region. One of the electrical connectors includes a perforated common ground shield at the mating region that reduces crosstalk while substantially matching impedance at the mating region to a desired impedance of the electrical connector assembly.

20 Claims, 10 Drawing Sheets

ELECTRICAL CONNECTOR HAVING COMMON GROUND SHIELD

CROSS-REFERENCE TO RELATED APPLICATIONS

This is a continuation application of U.S. patent application Ser. No. 13/364,656, filed Feb. 2, 2012, which claims the benefit of U.S. Patent Application Ser. No. 61/444,344, filed Feb. 18, 2011, the disclosure of which is hereby incorporated by reference as if set forth in its entirety herein.

BACKGROUND

Electrical connectors typically include a connector housing and a plurality of electrical contacts supported by the connector housing. The electrical contacts can include one or more signal contacts alone or in combination with one or more ground contacts. The signal contacts can be provided as single-ended contacts or can be provided as differential signal pairs. The electrical contacts define a mating end disposed at a mating interface of the electrical connector, and an opposed mounting end disposed at a mounting interface of the electrical connector. The mating ends are configured to mate with complementary mating ends of corresponding electrical contacts of an electrical component, which can be another electrical connector or alternative electrical device, and the mounting ends can be configured to connect to a substrate, such as a printed circuit board.

Certain conventional electrical connectors include a plurality of adjacent leadframe assemblies, such as insert molded leadframe assemblies (IMLAs) that each includes a dielectric leadframe housing that is overmolded onto a plurality of the electrical contacts. The leadframe assemblies can be supported in the connector housing, such that the electrical contacts define a desired array of signal and ground contacts. Unfortunately, signal contacts can be so closely spaced that undesirable interference, or "cross talk," occurs between adjacent signal contacts. Cross talk occurs when a signal in one signal contact induces electrical interference in an adjacent signal contact due to interfering electrical fields, thereby compromising signal integrity. Cross talk may also occur between differential signal pairs, and increases with reduced distance between the interfering signal contacts. Cross talk may be reduced by separating adjacent signal contacts or adjacent differential signal pairs with ground contacts.

Conventionally, metallic crosstalk shields have been added to an electrical connector to further reduce crosstalk. For instance, external plates in the form of crosstalk shields can be placed between adjacent leadframe assembles. In some instances, it is known to electrically common the ground contacts using an electrically conductive ground shorting plate that is disposed on the front face of the connector housing and electrically connected to one or more, up to all, of the ground contacts, and electrically isolated from the signal contacts.

SUMMARY

In accordance with one embodiment, a common ground shield is configured to be at least partially disposed at a mating interface of an electrical connector. The common ground shield includes a substantially planar shield body configured to be placed in electrical communication with a substrate at one end and a complementary ground member at a second end. The common ground shield defines a plurality of windows that extend through the body so as to reduce crosstalk and substantially match a desired impedance level.

BRIEF DESCRIPTION OF THE DRAWINGS

The foregoing summary, as well as the following detailed description of preferred embodiments of the application, will be better understood when read in conjunction with the appended drawings. For the purposes of illustrating the embodiments of the present disclosure, there is shown in the drawings preferred embodiments. It should be understood, however, that the disclosure is not limited to the precise arrangements and instrumentalities shown. In the drawings.

DETAILED DESCRIPTION

Figure 1:
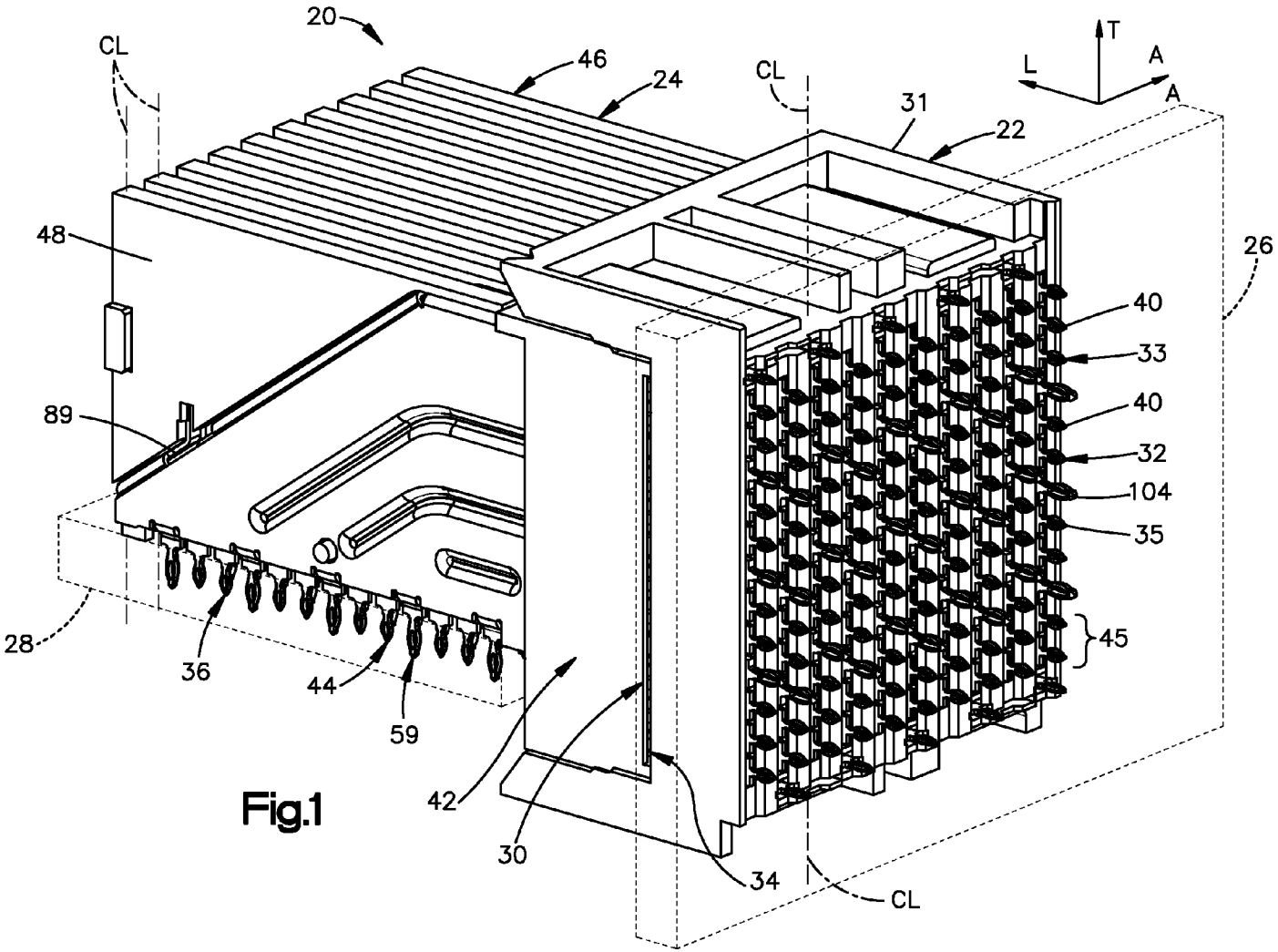
FIG. 1 is a perspective view of an electrical connector assembly including a vertical header connector and a right-angle receptacle connector in connection with one embodiment.

Referring initially to FIG. 1, an electrical connector assembly 20 includes a first electrical connector 22 and a second electrical connector 24, and first and second complementary electrical components, such as a first substrate 26 and a second substrate 28, respectively. The first electrical connector 22 is configured to be mounted to the first substrate 26, and the second electrical connector 24 is configured to be mounted to the second substrate 28. The first and second electrical connectors 22 and 24 are configured to mate with each other so as to establish an electrical connection between the first and second substrates 26 and 28. In accordance with the illustrated embodiment, each substrate 26 and 28 can be configured as a printed circuit board (PCB).

Figure 2A:
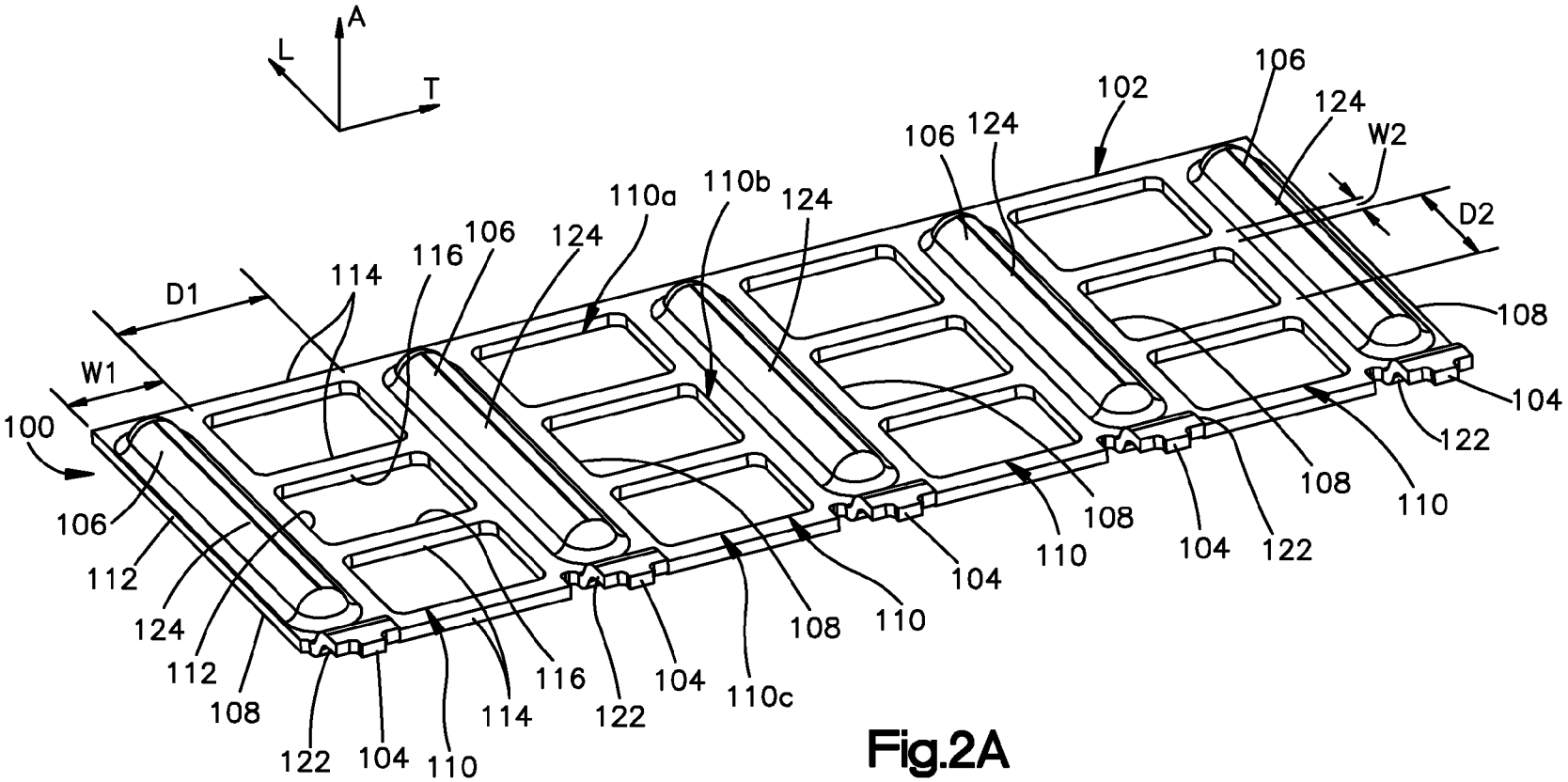
FIG. 2A is a perspective view of a common ground shield constructed in accordance with one embodiment.
Figure 2B:
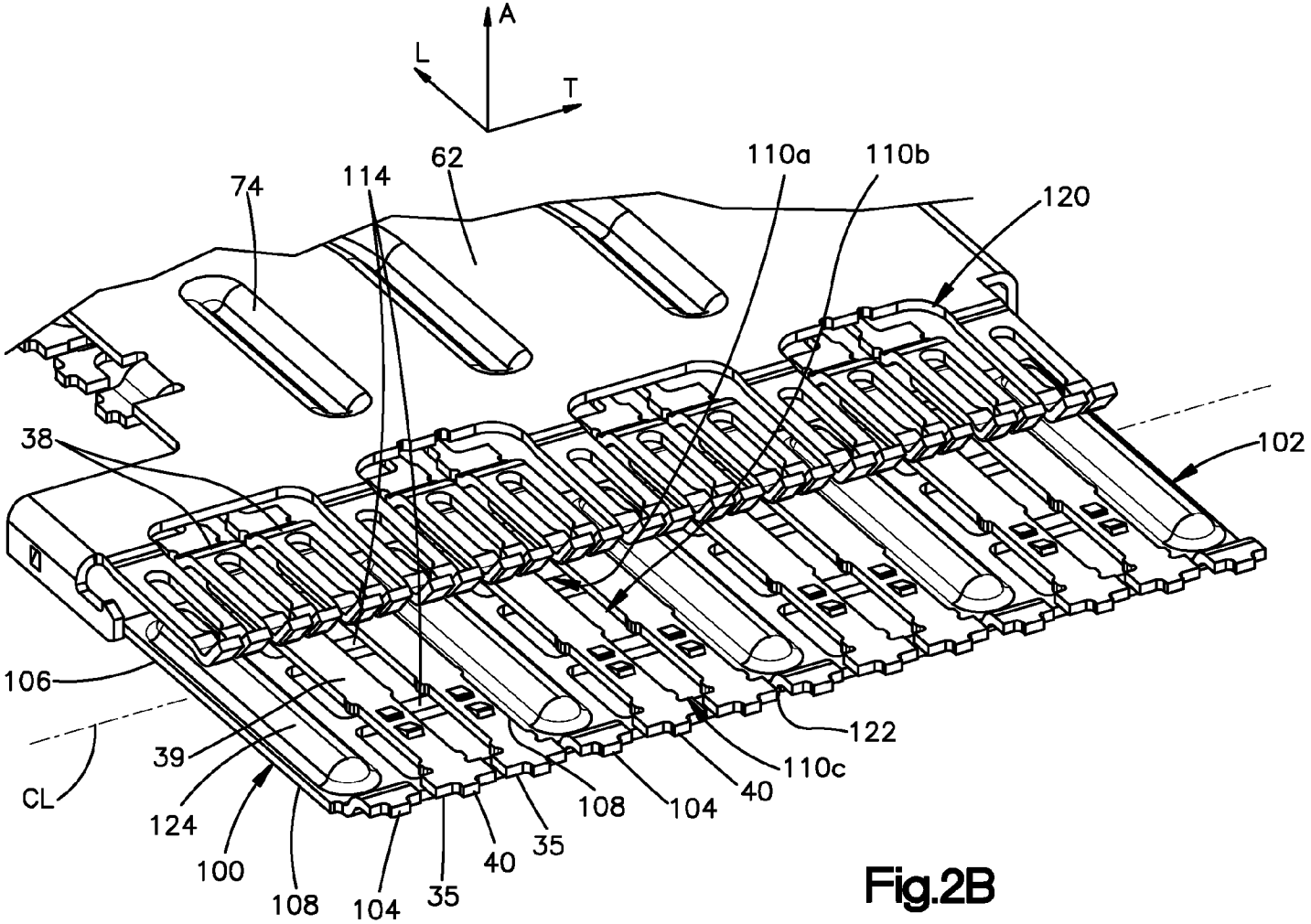
FIG. 2B is an enlarged perspective view of a portion of the electrical connector assembly illustrated in FIG. 1, illustrating the common ground shield attached to the right-angle receptacle connector, shown with the connector housing of the vertical header connector removed.
Figure 2C:
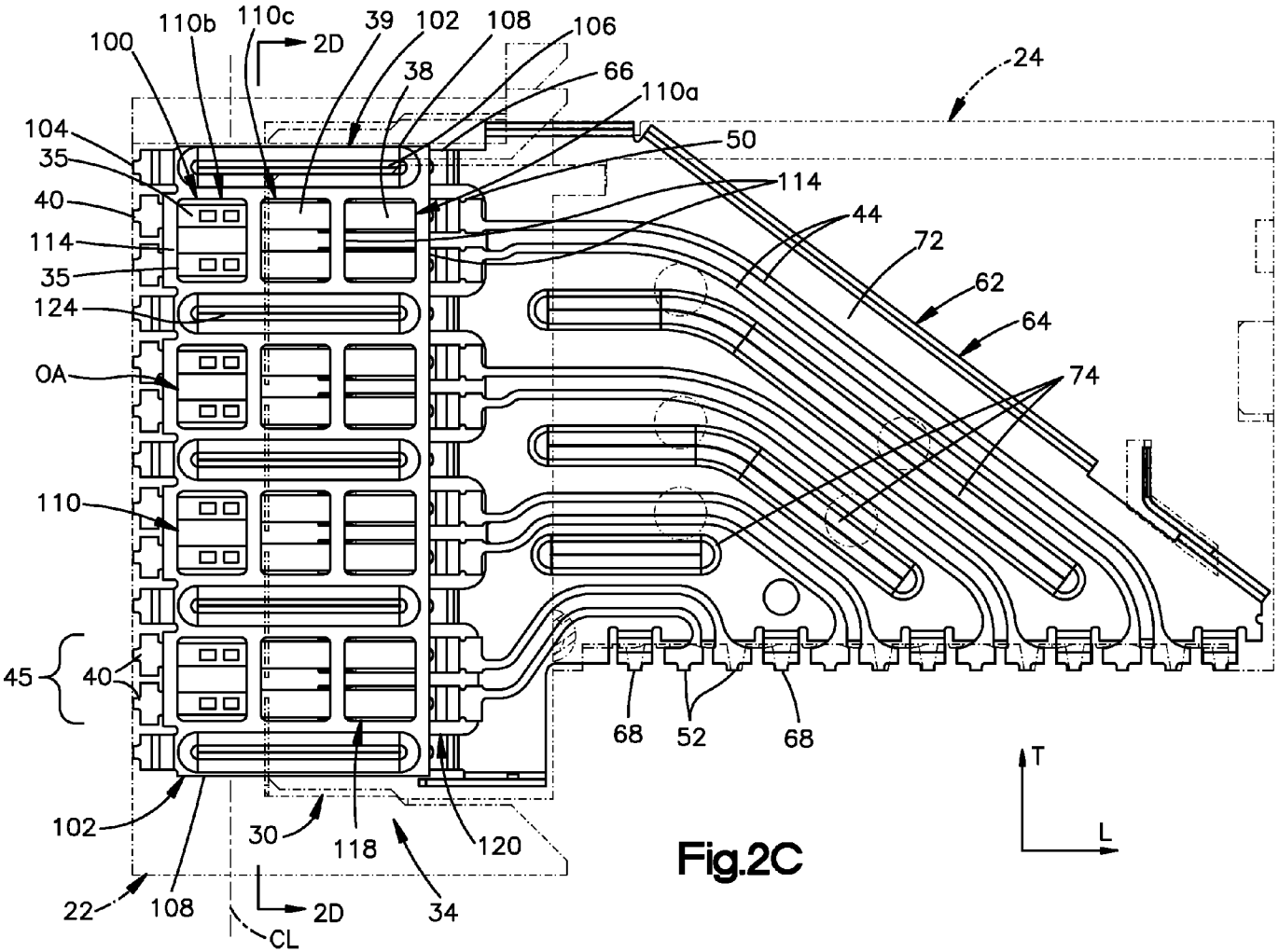
FIG. 2C is a schematic side elevation view of the electrical connector assembly illustrated in FIG. 1, with the housing illustrated as transparent to show the common ground shield disposed at a mating interface of the vertical header connector and the right-angle receptacle connector.
Figure 2D:
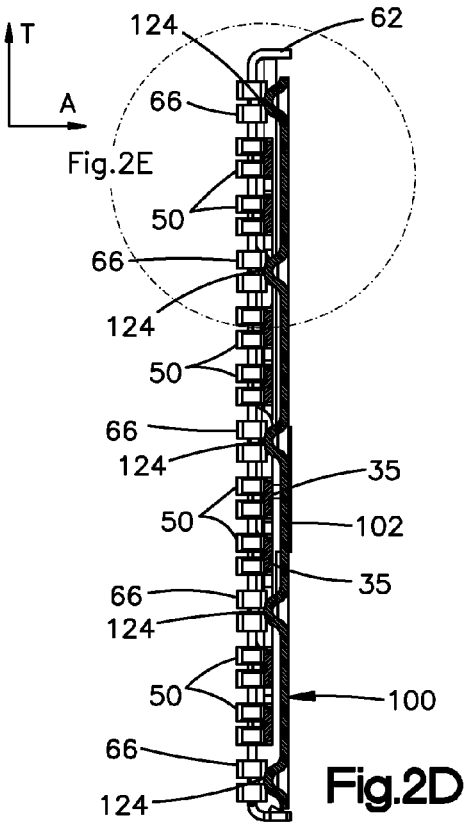
FIG. 2D is a sectional end elevation view of the electrical connector assembly illustrated in FIG. 2C, taken along line 2D-2D.

The first electrical connector 22 includes a dielectric or electrically insulative connector housing 31 and a plurality of electrical contacts 33 that are supported by the connector housing 31. The electrical contacts 33 can include a plurality of electrical signal contacts 35 that may be insert molded by a leadframe housing prior to attachment of the leadframe housing to the connector housing 31, stitched into a leadframe housing prior to attachment of the leadframe housing to the connector housing 31, insert molded by connector housing 31, stitched into the connector housing 31, or otherwise supported by the connector housing 31. The electrical signal contacts 35 define respective mating ends 38 (see FIG. 2C) that extend along a mating interface 30 of the first electrical connector 22, mounting ends 40 that extend along a mounting interface 32 of the first electrical connector 22, and body portions 39 (see FIG. 2C) that extend substantially along a first or longitudinal direction L between the mating ends 38 and the mounting ends 40. The first electrical connector 22 is configured to mate with the second electrical connector 24 at the mating interface 30, such that the electrical contacts 33 mate with complementary electrical contacts of the second electrical connector 24. The longitudinal direction L can define a longitudinally forward direction and can also be referred to as an insertion or mating direction, as the first and second electrical connectors 22 and 24 can be mated when one or both of the first and second electrical connectors 22 and 24 can be brought toward the other in the mating direction. The first electrical connector 22 is further configured to be mounted to a complementary electrical component, such as the first substrate 26, at the mounting interface 32, such that the electrical contacts 33 are mounted to electrical traces of the first substrate 26, which can be configured as a backplane, midplane, daughtercard, or the like. For instance, the mounting ends 40 may be press-fit tails, surface mount tails, or fusible elements such as solder balls.

Each of the electrical signal contacts 35 can define respective first and second opposed broadsides and first and second edges connected between the broadsides. The edges define a length along a lateral direction A that is substantially perpendicular to the longitudinal direction L, and the broadsides define a length along a transverse direction T that is substantially perpendicular to the lateral direction A and the longitudinal direction L. The length of the edges is less than the length of the broadsides, such that the electrical signal contacts 35 define a rectangular cross section. At least one or more pairs of adjacent electrical signal contacts 35 can be configured as differential signal pairs 45 arranged in a plurality of columns CL that extend along the transverse direction T, which can define a column direction, and are spaced from each other along the lateral direction A, which can define a row direction. In accordance with one embodiment, the differential signal pairs 45 are edge coupled, that is the edges of each electrical contact of a given differential pair 45 face each other along a common one of the columns CL. Thus, the electrical connector 22 can include a plurality of differential signal pairs arranged along a given one of the columns CL. As illustrated, the electrical connector 22 can include four differential signal pairs 45 positioned edge-to-edge along each column CL, though the electrical connector 22 can include any number of differential signal pairs along a given one of the columns CL as desired, such as two, three, four, five, six, or more differential signal pairs. The first electrical connector 22 can include any number of columns CL as desired.

As illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" are used to describe the perpendicular directional components of various components. The terms "inboard" and "inner," and "outboard" and "outer" with respect to a specified directional component are used herein with respect to a given apparatus to refer to directions along the directional component toward and away from the center apparatus, respectively.

Figure 2E:
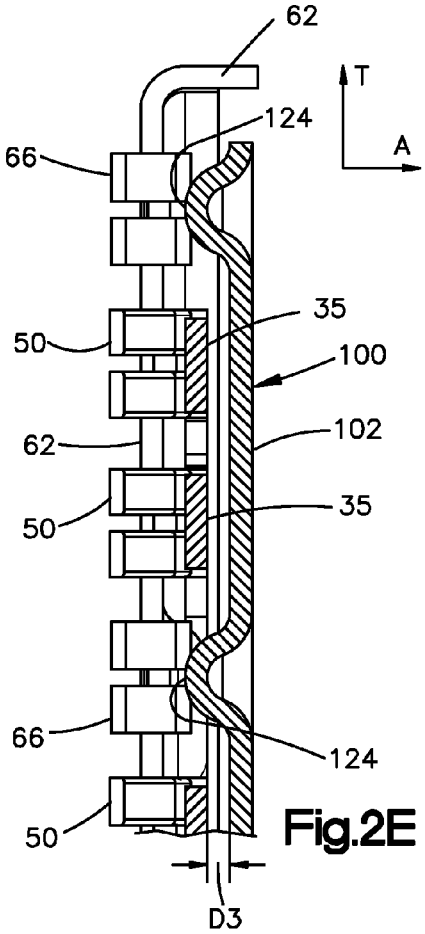
FIG. 2E is an enlarged portion of the sectional end elevation view of the electrical connector assembly illustrated in FIG. 2D, taken along line 2E.
Figure 3A:
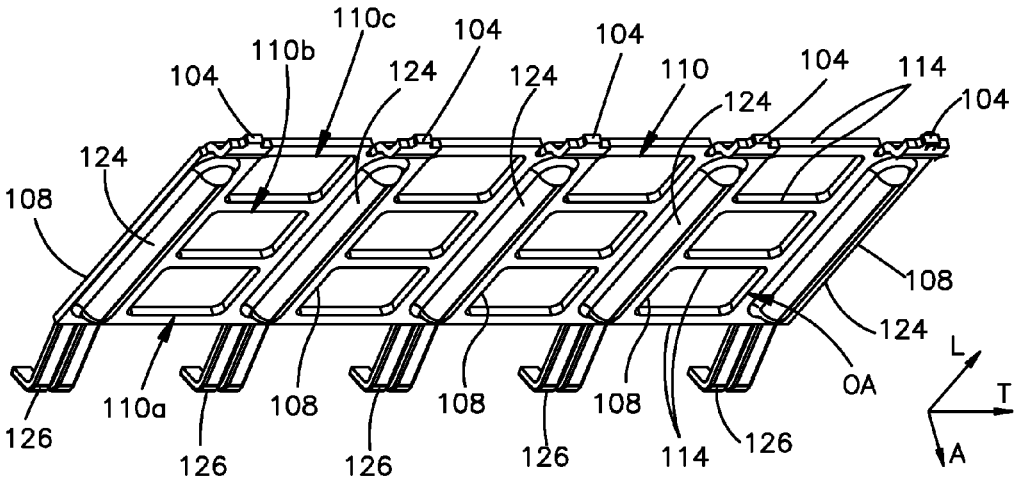
FIG. 3A is a perspective view of a common ground shield similar to the common ground shield illustrated in FIG. 2B, but constructed in accordance with an alternative embodiment.
Figure 3B:
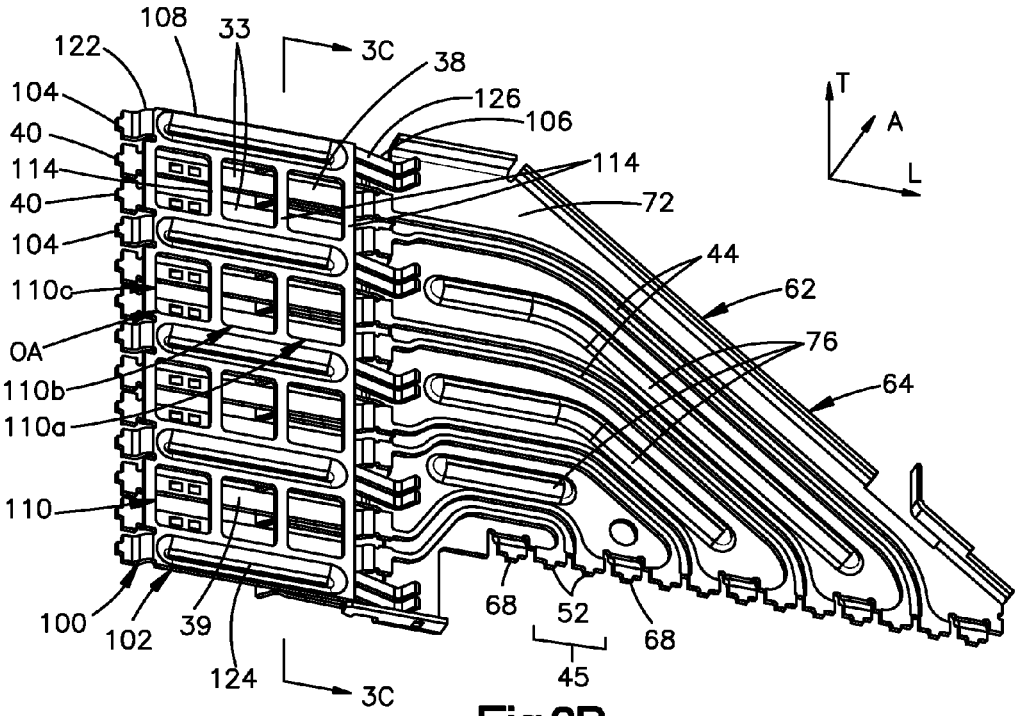
FIG. 3B is a perspective view of the electrical connector assembly as illustrated in FIG. 1, but including the ground shield illustrated in FIG. 3A.
Figure 3C:
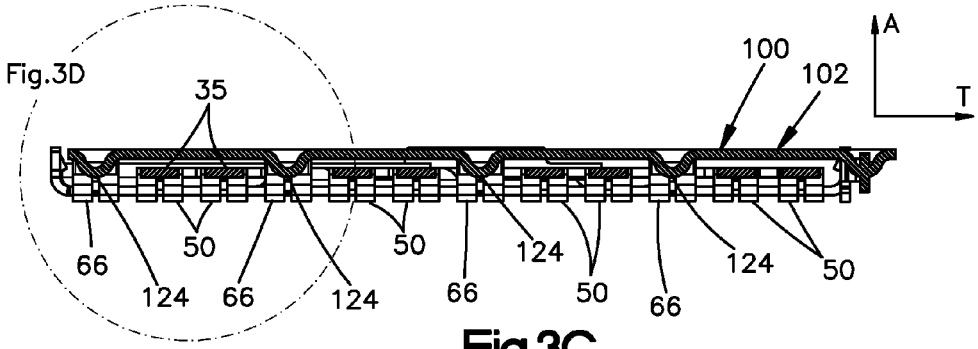
FIG. 3C is a sectional end elevation view of the electrical connector assembly illustrated in FIG. 3B, taken along line 3C-3C.
Figure 3D:
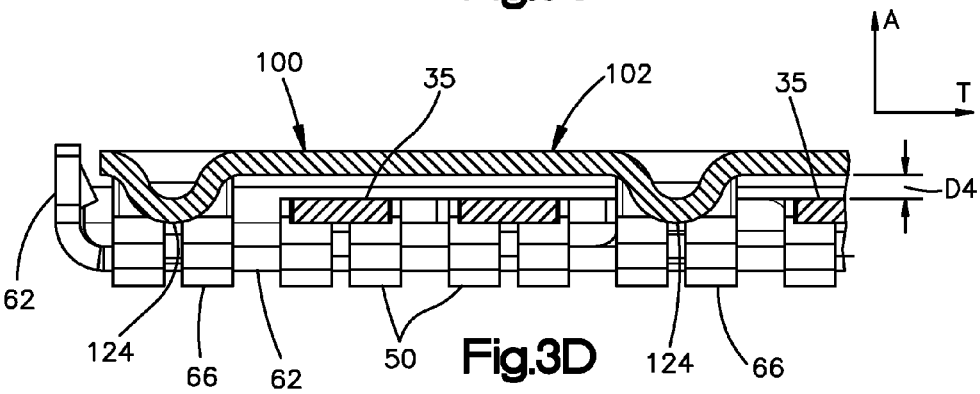
FIG. 3D is an enlarged portion of the sectional end elevation view of the electrical connector assembly illustrated in FIG. 3C, taken along line 3D.

Referring now to FIGS. 1-2E, the first electrical connector 22 can further include at least one electrically conductive common ground shield 100 such as a plurality of common ground shields 100 that are configured to mate with respective ground members 59 of the second connector 24 when the first and second electrical connectors 22 and 24 are mated. The ground members 59 are thus configured to mate with the common ground shield 100, and are configured to be mounted to the second substrate 28 as is described in more detail below. The common ground shield 100 can be formed from any suitable electrically conductive material, such as a metal or a lossy material that can be electrically conductive. As will be appreciated from the description below, the common ground shields 100 can establish an electrical ground connection between the first and second electrical connectors 22 and 24 when mated.

The common ground shields 100 can be disposed at the mating interface 30, and include a perforated shield body 102 that can be substantially planar along a plane defined by the longitudinal and transverse directions L and T when supported by the connector housing 31, and offset with respect to the corresponding column CL defined by the electrical signal contacts 35, such that the shield body 102 does not contact the signal contacts 35. The first electrical connector 22 includes a plurality of ground mounting ends 104 that extend out from the shield body 102 along a first direction. The ground mounting ends 104 can be integral with the shield body 102 or can be separate from the shield body 102 such that the ground mounting ends 104 are in electrical communication with a second end of the shield body 102 when the shield body 102 is supported by the connector housing 31. The ground mounting ends 104 can be substantially aligned with the mounting ends 40 of the electrical signal contacts 35 along the common column CL, and may be press-fit tails, surface mount tails, or fusible elements such as solder balls, which are configured to electrically connect to a complementary electrical component such as the first substrate 26.

The common ground shield 100 can be supported by the connector housing 31 such that the ground mounting ends 104 are disposed adjacent or between a pair of mounting ends 40 of adjacent electrical signal contacts 35 along the transverse direction T. For instance, the ground mounting ends 104 of the common ground shield 100 and the mounting ends 40 of the signal contacts 35 can be equidistantly spaced along the mounting interface 32 of the electrical connector 22 along the common column CL. In accordance with one embodiment, the ground mounting ends 104 can be disposed between the mounting ends of 40 of the signal contacts 35 that define adjacent differential signal pairs 45 spaced along the common column CL. Thus, depending on the contact arrangement, the first electrical connector 22 can define a repeating G-S-S pattern whereby "G" identifies one of the ground mounting ends 104 of the common ground shield 100, and "S" identifies one of the mounting ends 40 of an electrical signal contact 35, wherein the two adjacent "S"s in the repeating G-S-S can identify the mounting ends 40 of signal contacts 35 of a differential signal pair 45. It should be appreciated a first one of the columns CL can define a first contact arrangement of a repeating G-S-S from the top of the column CL to the bottom of the column CL, and a second one of the columns CL adjacent to the first one of the columns CL can define a second contact arrangement different than the first contact arrangement. For instance, the second contact arrangement can define a repeating S-S-G from the top of the column CL to the bottom of the column CL. Thus the columns CL can define repeating first and second contact arrangements across the first electrical connector 22 along the lateral direction A (and further across the second electrical connector 24 along the lateral direction A as will be appreciated from the description below). Alternatively, the second contact arrangement can be the same as the first contact arrangement.

The first electrical connector 22 further includes a plurality of ground mating ends 106 that extend out from the shield body 102 along a second direction opposite that of the first direction that the ground mounting ends 104 extend from the shield body 102. The ground mating ends 106 can be integral with the shield body 102 or can be separate from the shield body 102 such that the ground mating ends 106 are in electrical communication with a second end of the shield body 102 when the shield body 102 is supported by the connector housing 31. The ground mating ends 106 can be substantially aligned with the mating ends 38 of the electrical signal contacts 35 along the common column CL and configured to electrically connect to complementary mating ends of the ground members 59 of the second electrical connector 24 when the first and second electrical connectors 22 and 24 are mated.

The ground mating ends 106 can be substantially inline with the ground mounting ends 104 along the longitudinal direction L, such that a line extending along the longitudinal direction L can pass through one of the ground mating end 106 and an aligned one of the ground mounting ends 104. The ground mating ends 106 are disposed between a pair of mating ends 38 of the signal contacts 35 along the transverse direction T. The ground mating ends 106 can be aligned with the mating ends 38 of the signal contacts 35 along the transverse direction T, such that a line extending along the transverse direction T can pass through the ground mating ends 106 and the mating ends 38 of the signal contacts 35. Similarly, the ground mounting ends 104 can be aligned with the mounting ends 40 of the signal contacts 35 along the transverse direction T, such that a line extending along the transverse direction T can pass through the ground mounting ends 104 and the mounting ends 40 of the signal contacts 35. The ground mating ends 106 and the mating ends 38 can be equidistantly spaced along the mating interface 30 of the electrical connector 22 along the common column CL. Accordingly, the ground mating ends 106 can be disposed between adjacent differential signal pairs 45 along the common column CL. As is described in more detail below, each of the ground mating ends 106 can be defined by a respective rib 124 that projects outwardly from the shield body 102 toward a corresponding common column CL of the signal contacts 35 with which the ground mounting ends 104 and the ground mating ends 106 are aligned.

The shield body 102 can be at least partially offset with respect to the corresponding common column CL along the lateral direction A. For instance, the shield body 102 can extend substantially along a plane that is laterally offset with respect to the corresponding common column CL, and is thus laterally offset with respect to the electrical signal contacts 35 and the ground mounting ends 104. In accordance with the illustrated embodiment, the shield body 102 includes at least one first body member such as a plurality of first body members that can be configured as first beams 108 that can be elongate along a first direction, which can define the longitudinal direction L. Accordingly, each of the first beams 108 can be elongate along the longitudinal direction L between the ground mounting ends 104 and the ground mating ends 106.

The first beams 108 can define opposed transverse edges 112 that are spaced apart, for instance along the transverse direction T. Accordingly, each of the first beams 108 can define a first dimension or width W1 that extends along the transverse direction T between the outer transverse edges 112. Adjacent ones of the first beams 108 can be spaced apart a first distance D1 along a second direction that can be angularly offset, such as substantially perpendicular, with respect to the first direction. In accordance with the illustrated embodiment, the second direction can define transverse direction T. For instance, the second distance D2 can be defined between adjacent transverse edges 112 of adjacent first beams 108. It should be appreciated that as the first width W1 increases the first distance D1 can correspondingly decrease, and as the first width W1 decreases the first distance D1 can correspondingly increase. The first beams 108 can be longitudinally inline with the respective ground mounting ends 104 and the ground mating ends 106, and thus can be equidistantly disposed between adjacent electrical signal contacts 35, and in particular disposed adjacent and between differential signal pairs 44. In accordance with the illustrated embodiment, the first beams 108 are disposed between and adjacent the body portions 39 of the electrical signal contacts 35. The common ground shield 100 defines at least one aperture 110 such as a plurality of apertures 110 that extend through the shield body 102 along the lateral direction A at a location that is spaced from and between adjacent ones of the first beams 108 along the transverse direction T. Accordingly, one or more of the apertures 110 up to all of the apertures 110 can extend along the second distance D2 in the transverse direction T.

The shield body 102 can further include at least one second body member such as a plurality of second body members that can be configured as second beams 114 that are elongate along a second direction, which can be parallel to the first direction, for instance substantially along the transverse direction T. In particular, the second beams 114 can extend along the transverse direction T between adjacent ones of the first beams 108. One or more of the second beams 114 up to all of the second beams 114 can be connected between and to adjacent ones of the first beams 108. In accordance with the illustrated embodiment, the second beams 114 can be substantially coplanar with the first beams 108 and can extend between, and can be connected between, one or more up to all respective pairs of adjacent ones of the first beams 108. Accordingly, the second beams 114 can be offset with respect to the signal contacts 35 in the transverse direction T, such that a line extending along the transverse direction does not pass through the second beams 114 and the signal contacts 35. Similarly, the first beams 108 can be offset with respect to the signal contacts 35 in the transverse direction T, such that a line extending along the transverse direction does not pass through the first beams 108 and the signal contacts 35. Furthermore, each of the second beams 114 extending between adjacent pairs of first beams 108 can be substantially aligned along the transverse direction T. Similarly, each of the first beams 108 can be substantially aligned along the transverse direction T. It should further be appreciated that while each of the second beams 114 are connected between adjacent ones of the first beams 108 in accordance with the illustrated embodiment, the second beams 114 can further be continuous across ones of the first beams 108 so as to extend between and through one or more, up to all, of the first beams 108.

The second beams 114 can be spaced apart substantially along the longitudinal direction L so as to divide the aperture 110 into at least one window such as a plurality of first windows 110*a*, second windows 110*b*, and third windows 110*c*. Thus, the second beams 114 can also be referred to as divider beams. It should be appreciated that the shield body 102 can define as many second beams 114 as desired between adjacent ones of the first beams 108, so as to define as many corresponding windows as desired. In accordance with the illustrated embodiment, the first windows 110*a* can define first outer windows that are forward-most along the longitudinal direction L, the second windows 110*b* can define second outer windows that are rear-most along the longitudinal direction L, and the third windows 110*c* define intermediate windows that are disposed between the first and second windows 110*a* and 110*b* along the longitudinal direction L. The shield body 102 can define as third windows 110*c* disposed between the first and second windows 110*a* and 110*b* as desired. One or more of the windows 110*a-c* up to all of the windows 110*a-c* can all overlap respective ones of the electrical signal contacts 35 as illustrated along the lateral direction A, such that a line extending along the lateral direction A can pass through a respective one of the signal contacts and a respective one of the windows 110*a-c*. Furthermore, select ones of the second beams 114 can span across a corresponding pair of the signal contacts 35 that extend between the pair of first beams 108 from which the select ones of the second beams 114 extend. The second beams 114 can be spaced from the signal contacts 35 along the lateral direction A such that the second beams 114 are electrically isolated from the signal contacts 35.

At least one or more of the windows 110*a-c* up to all of the windows 110*a-c* can be defined by an enclosed perimeter that includes a pair of the second beams 114 and at least a portion of a pair of first beams 108. The second beams 114 can define opposed outer edges 116 that are spaced apart, for instance along the longitudinal direction L, so as to define a second dimension or width W2 that is defined along the longitudinal direction L between the outer edges 116 of at least one of the second beams 114 up to all of the second beams 114. The shield body 102 defines a second distance D2 that is defined between adjacent outer edges 116 of adjacent ones of the second beams 114 along the longitudinal direction. It should be appreciated that as the second width W2 increases, the second distance D2 can correspondingly decrease, and as the second width W2 decreases, the second distance D2 can correspondingly increase. It should be appreciated that the second distances D2 defines the respective dimensions of each of the windows 110*a-c* along the longitudinal direction, and that the second distance D2 of one of the windows 110*a-c* can differ from one or more up to all of the other windows 110*a-c*.

Figure 4A:
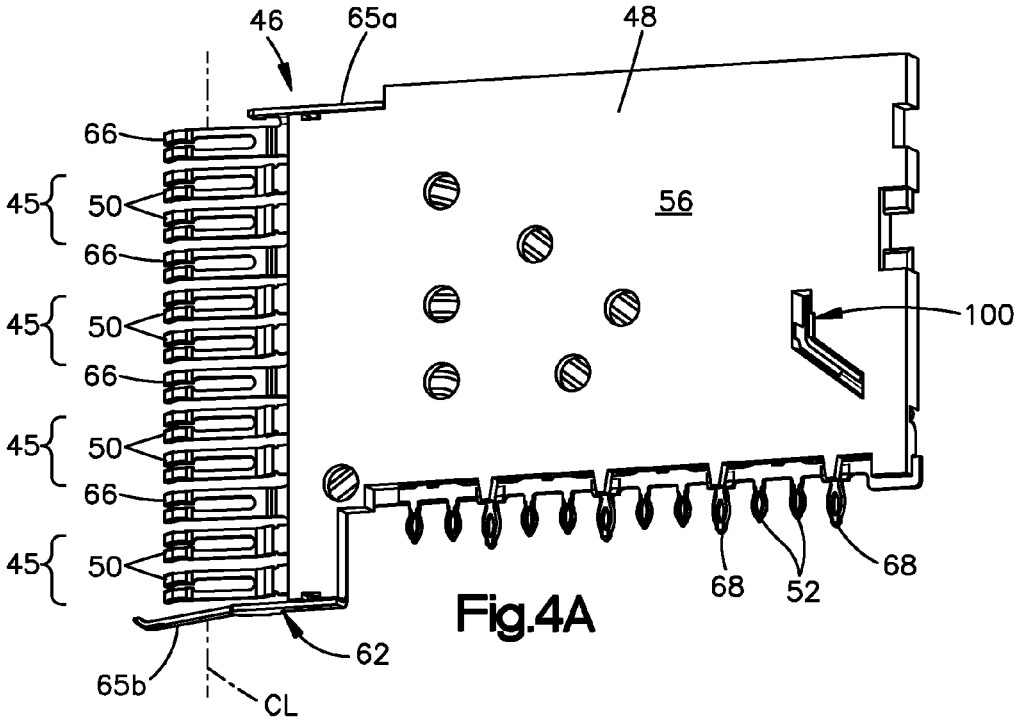
FIG. 4A is a perspective view of one of a first plurality of leadframe assemblies of the right-angle electrical connector illustrated in FIG. 1.

It should be appreciated that the second beams 114 place the first beams 108 of the first electrical connector 22 in electrical communication with each other so as to establish a common ground path between 1) two or more of the ground mating ends 106, up to all, of the ground mating ends 106, 2) two or more of the ground mounting ends 104, up to all, of the ground mounting ends 104, and 3) at least one of the ground mating ends 106 up to all of the ground mating ends 106 and at least one of the ground mounting ends 104 up to all of the ground mounting ends 104. When the first and second electrical connectors 22 and 24 are mated, and the corresponding ground mating ends 106 and 66 (see FIG. 4A) are mated, the common ground shield 100 establishes a common ground that extends across the mating interfaces 30 and 34 of both electrical connectors 22 and 24. Thus, the common ground shield 100 establishes a common electrical ground path across the first electrical connector 22 before the first and second electrical connectors 22 and 24 are mated. The common ground shield 100 further establishes an electrical ground path across the mating interface 34, and in particular across at least two of the ground mating ends 66 up to all of the ground mating ends 66 of the second electrical connector 24 after the first and second electrical connectors 22 and 24 are mated. The first and second electrical connectors 22 and 24 can thus define respective first and second ground paths that, in turn, define a ground path common to both of the first and second electrical connectors 22 and 24 when the first and second electrical connectors 22 and 24 are mated.

It should be appreciated that the shield body 102 defines a plurality of apertures 110 that can extend between adjacent first beams 108, and can further extend between adjacent second beams 114. While the apertures 110 are substantially rectangular in shape in a plane defined by the longitudinal and transverse directions L and T, it should be appreciated that the apertures 110 can define any shape as desired depending, for instance, on the geometry of the outer edges 112 of the first beams 108 and the outer edges 116 of the second beams 114. While the shield body 102 defines four second beams 114 and three corresponding windows 110*a-c* between each adjacent pair of first beams 108, it should be appreciated that the shield body 102 can include as many second beams 114 as desired so as to define as many corresponding apertures 110 as desired. Furthermore, each of the windows 110*a-c* defines a respective area which is a product of the first distance D1 and the second distance D2. Thus, it should be appreciated that the area of each of the windows 110*a-c* can be varied, for instance by varying the first and second widths W1 and W2 of the first and second beams 108 and 114, respectively, and by varying the number of second beams 114 so as to correspondingly vary the distance between adjacent ones of the second beams 114 along the longitudinal direction L. It should be further appreciated that the cumulative area of the apertures 110, and thus the cumulative area of the windows 110*a-c*, defines an overall open area OA of the shield body 102. The overall open area OA of the shield body 102 can be increased and decreased, for instance, by varying the number of windows 110*a-c* and further by varying the size of the windows 110*a-c* in the manner described above. Accordingly, a kit of common ground shields 100 can be provided having different open areas, and different areas of one or more up to all of the windows 110*a-c*.

It is recognized that the first and second electrical connectors 22 and 24 define a mating region 118 that can be defined, for instance, as a region at which at least one or both of the mating ends 38 and the ground mating ends 106 overlap with at least one or both of ground mating ends 66 and mating ends 50 of electrical signal contacts 44 of the second electrical connector 24 (see FIG. 4A), respectively, along the lateral direction A when the first and second electrical connectors 22 and 24 are mated. It is further appreciated that as the overall open area OA of the shield body 102 is increased, the impedance at the mating region 118 is likewise increased. For instance, if the shield body 102 was not perforated, and thus had an overall open area of zero, the impedance at the mating region 118 would be substantially below a desired impedance of the electrical connector assembly 20 such that the impedance at the mating region 118 would be mismatched with respect to the desired impedance of the electrical connector assembly 20.

Furthermore, the common ground shield 100 can be configured such that at least one or more up to all of the windows 110*a-c* at least partially overlaps one or both of the signal contacts 35 and the signal contacts 44 of the second electrical connector 24 when the first and second electrical connectors 22 and 24 are mated. In accordance with the illustrated embodiment, the first windows 110*a* of the common ground shield 100 can fully overlap at least a portion of both the signal contacts 35 and the signal contacts 44, for instance at the mating ends 50, at the mating region 118. The third window 110*c* of the common ground shield 100 can partially overlap at least a portion of the signal contacts 44 of the second electrical connector 24 at the mating region 118 as illustrated, or can fully overlap at least a portion of the signal contacts 44 of the second electrical connector 24 at the mating region 118. The area of each of the windows 110*a-c* can be reduced so as to reduce cross-talk at the mating region 118. For instance, in accordance with one embodiment, the area of each of the windows 110*a-c* can be smaller than the wavelength of the signals being transmitted across the signal contacts 35 and 44 of the first and second electrical connectors 22 and 24, respectively, when the first and second electrical connectors 22 and 24 are mated. The area of the windows 110*a-c* can be reduced as the frequency of the signals that travel across the electrical signal contacts 35 and 44 increases.

It should thus be appreciated that the number and area of the individual windows 110*a-c* as well as the overall open area OA can be tuned so that the impedance at the mating region 118 substantially matches the desired impedance of the electrical connector assembly 20, and the crosstalk is reduced, while allowing the common ground shield 100 to establish a common ground path across respective ground members at the mating interfaces 30 and 34 of both of the first and second electrical connectors 22 and 24, for instance at the mating region 118, in the manner described above. Otherwise stated, the apertures 110 can define an area that balances impedance and crosstalk through the mating region 118, wherein crosstalk may rise as a function of signal frequency (or wavelength).

Figure 4B:
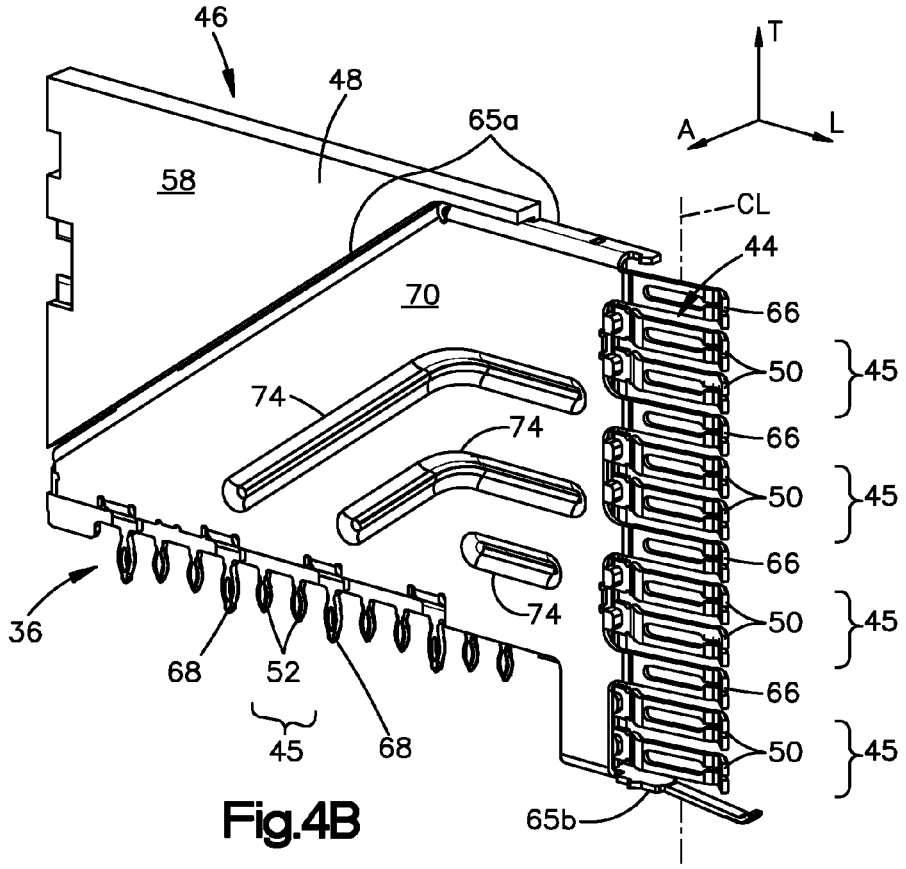
FIG. 4B is another perspective view of the leadframe assembly illustrated in FIG. 4A, showing a ground plate and a plurality of electrical signal contacts carried by a leadframe housing.
Figure 4C:
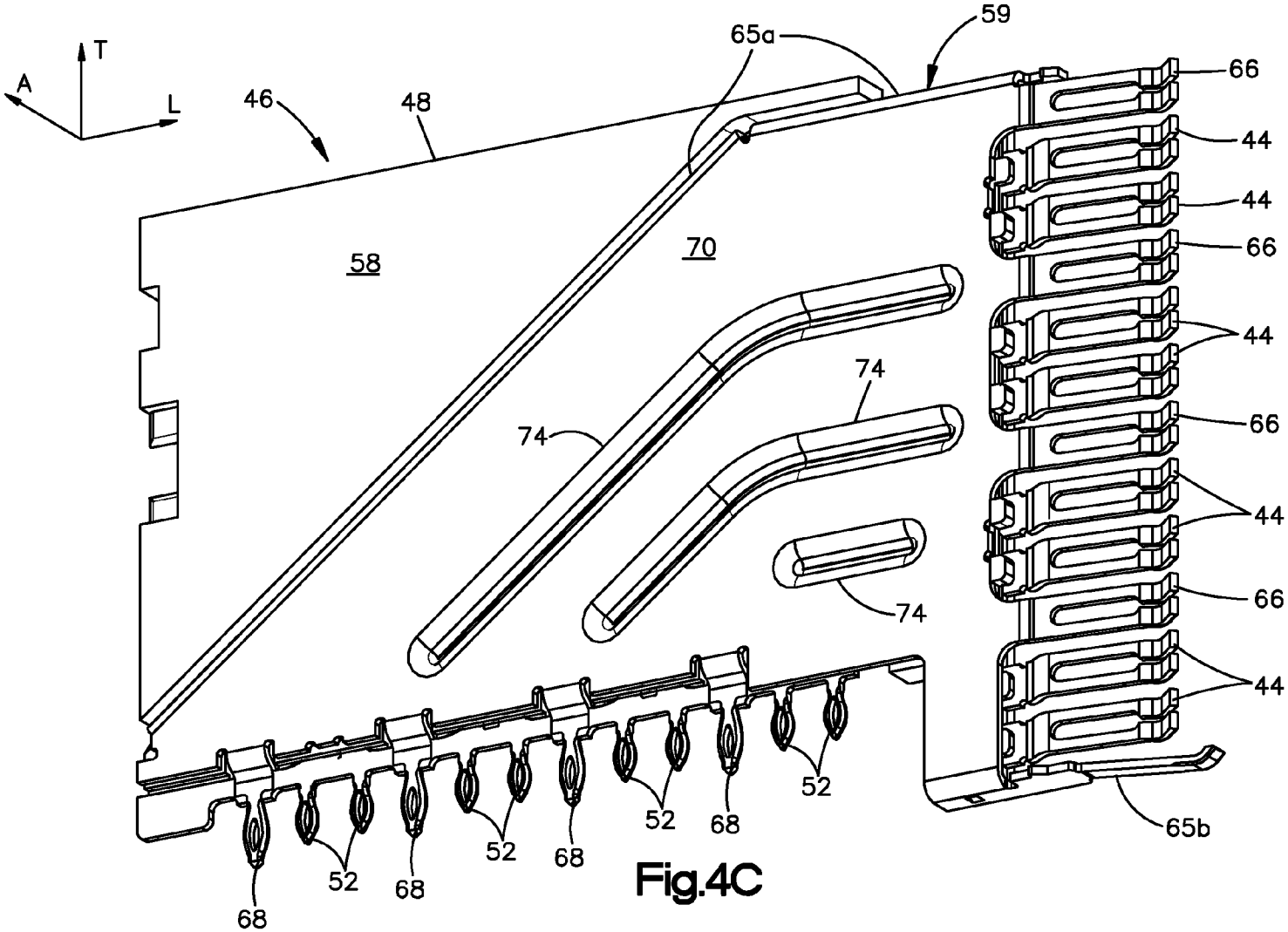
FIG. 4C is another perspective view of the leadframe assembly illustrated in FIG. 4A, showing a ground plate and a plurality of electrical signal contacts.
Figure 4D:
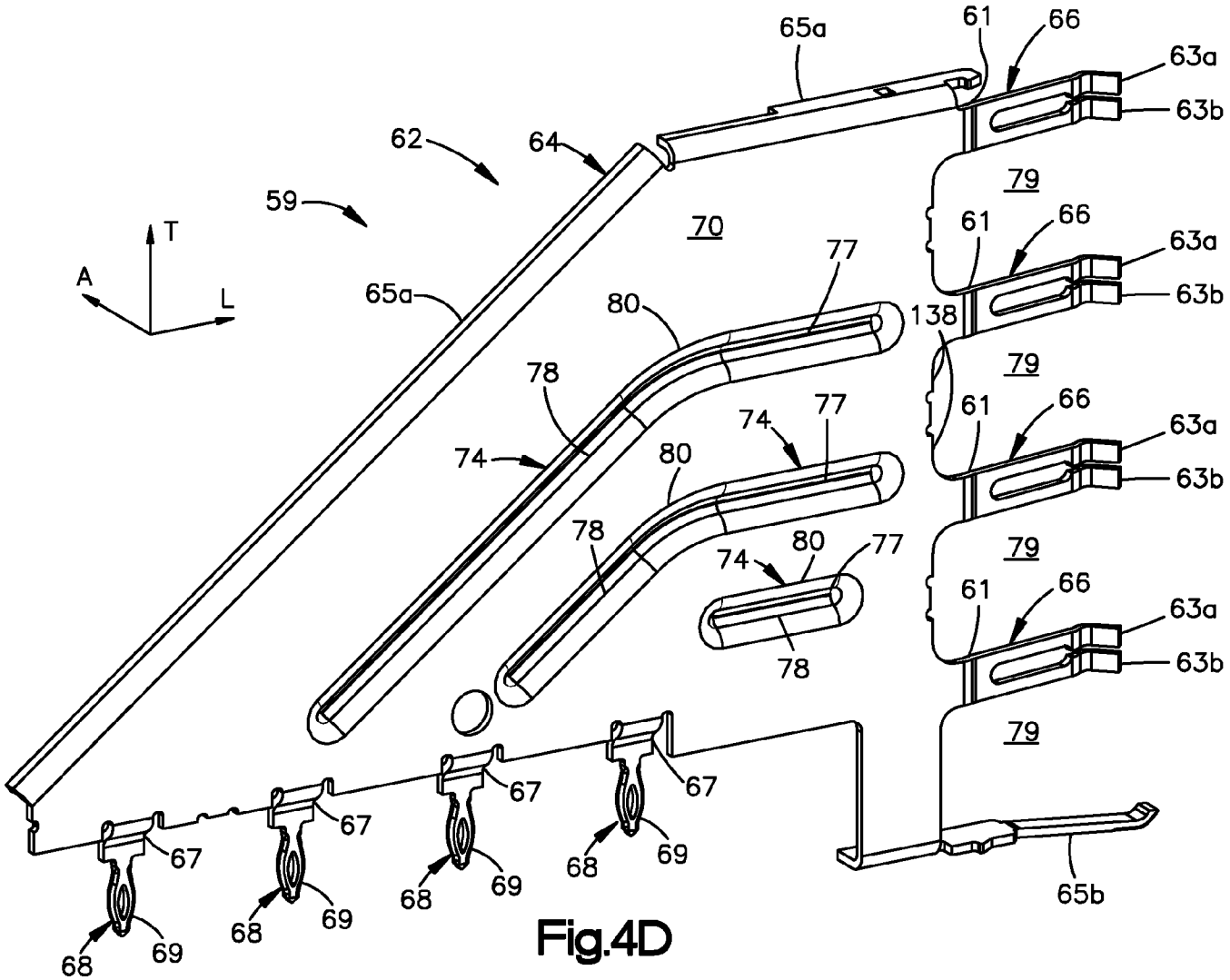
FIG. 4D is a perspective view of a ground plate of the leadframe assembly illustrated in FIG. 4C.
Figure 4E:
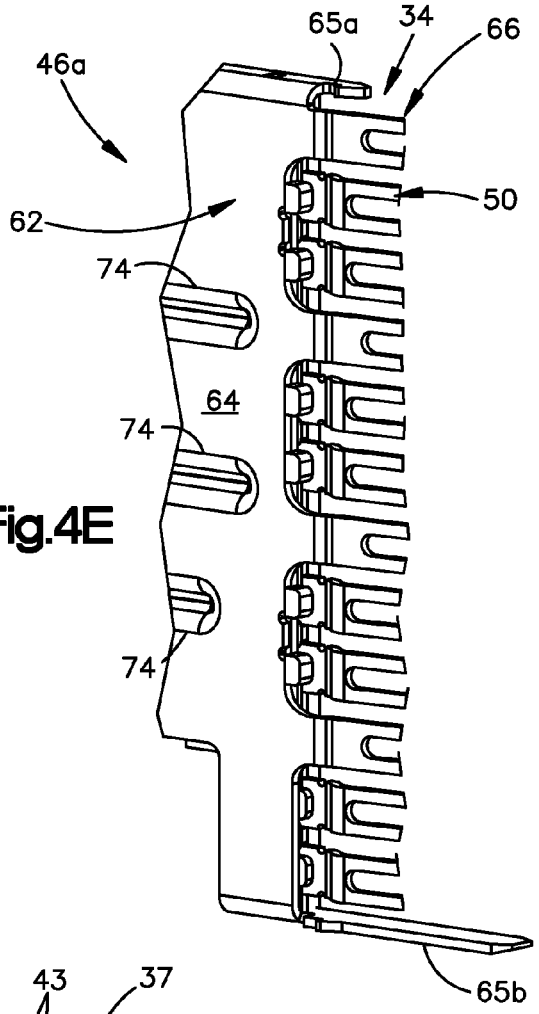
FIG. 4E is an enlarged perspective view of a portion of the mating end of the leadframe assembly illustrated in FIG. 4B.
Figure 4F:
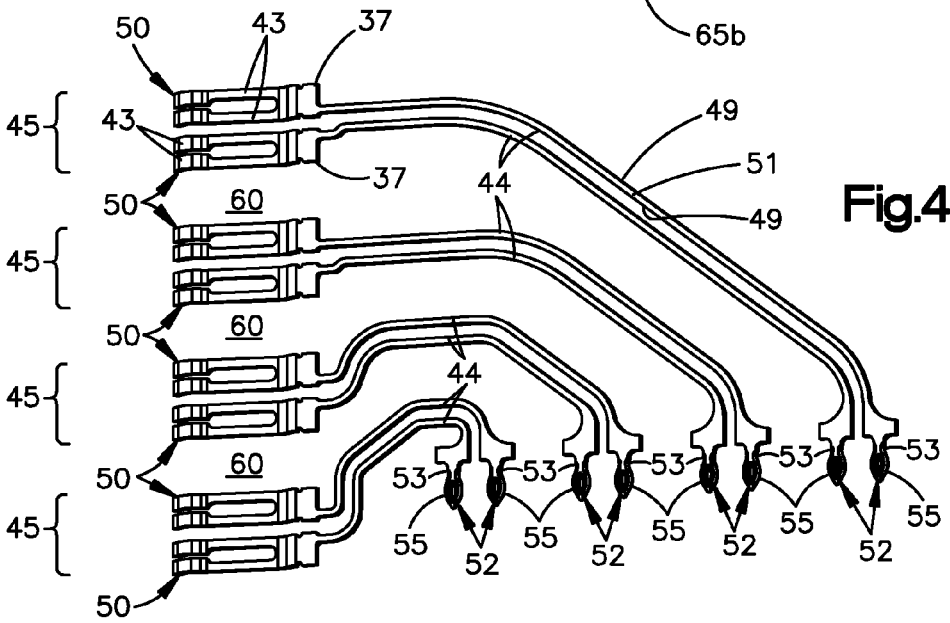
FIG. 4F is a perspective view of the electrical signal contacts of the leadframe assembly illustrated in FIG. 4A, arranged as supported by the leadframe housing.

Furthermore, the common ground shield 100 of the first electrical connector 22 can be spaced from a corresponding ground plate 62 of the second electrical connector (see FIG. 4B), for instance at a region that is aligned with the signal contacts 44 of the second electrical connector 24 along the transverse direction T, so as to define a plurality of gaps 120 that define a first distance along the longitudinal direction L that can be sufficiently close to, or substantially equal to, the second distance D2. The gaps 120 can further define a second distance along the transverse direction T between adjacent ones of the ground mating ends 66, which can be substantially equal to the first distance D1 that extends between adjacent ones of the first beams 108 of the common ground shield 100. For instance, it should be appreciated that the first beams 108 can be aligned with the ground mating ends 66 along the longitudinal direction L when the first and second electrical connectors 22 and 24 are mated. As a result, the gaps 120 can define respective areas that are sized so as to substantially maintain the impedance match across the mating region 118 while also reducing cross-talk at the mating interface 34. For instance, the area of each of the gaps 120 can be smaller than the wavelength of the signals being transmitted across the signal contacts 44 of the second electrical connector 24.

As described above, the shield body 102 is offset with respect to the electrical signal contacts 35 in the lateral direction A, such that the shield body 102 is spaced from the electrical signal contacts 35 along the lateral direction, for instance a distance D3 (see FIG. 2E). Furthermore, the ground mounting ends 104 can aligned with the mounting ends 40 of the signal contacts 35 along the transverse direction T. Thus, when the ground mounting portions 104 are integral with the shield body 102, the common ground shield 100 can include a transition region 122 that extends between the shield body 102 and each of the ground mounting portions 104. The transition regions 122 can extend rearward along the longitudinal direction L and outward along the lateral direction A toward the corresponding common column CL. The ground mounting portions 104 can extend rearward from the transition region 122 along the longitudinal direction L at a location that is substantially aligned with the mounting ends 40 of the signal contacts along the transverse direction T.

As described above, the common ground shield 100 can further include at least one rib 124, such as a plurality of ribs 124, that are supported by and project out from the shield body 102 along the lateral direction A so as to define a mating end, such as the ground mating end 106. In accordance with the illustrated embodiment, at least one up to all of the ribs 124 project out from a corresponding one of the first beams 108. In accordance with the illustrated embodiment, each rib 124 is embossed into the corresponding one of the first beams 108, and is thus integral with the corresponding one of the first beams 108. Thus, the ribs 124 can further be referred to as embossments, though it should be appreciated that the ribs 124 can be alternatively constructed as desired. The ribs 124 can be generally constructed as described below with respect to the ribs 74 of the ground plate 62 of the second electrical connector 24, and can project out from the first beams 108 along the lateral direction A a distance sufficient to make contact with the ground member 59, and in particular the ground mating ends 66, of the second electrical connector 24 when the first and second electrical connectors 22 and 24 are mated. Thus, the ground mating ends 106 of the first electrical connector 22 can be defined by the ribs 124 that project out from the first beams 108. At least a portion of the ribs 124 can be aligned with the signal contacts 35, for instance at the body portions 39, along the transverse direction T. For instance, at least a portion of the ribs 124 can be disposed between adjacent differential pairs 45 that are defined by the signal contacts 35, and can thus replace discrete ground contacts. Accordingly, the first electrical connector 22 can include the common ground shield 100 in place of discrete ground contacts that extend between adjacent differential signal pairs of conventional electrical connectors.

It should be appreciated that select performance characteristics of the common ground shield 100 can be tuned as desired. For instance, the area defined by the windows 110*a-c* can be adjusted as described above, the overall open area OA defined by the shield body 102 can be adjusted as described above, and the position of the shield body 102 relative to the signal contacts 44 of the second electrical connector 24 when the first and second electrical connectors 22 and 24 are mated can further be adjusted. For instance, the shield body 102 can be disposed longitudinally rearward, or closer to the ground mounting ends 104 than the embodiment illustrated in FIGS. 2A-E, which can 1) decrease a portion of the overall open area OA that overlaps the electrical signal contacts 44, for instance at the mating ends 50, when the first and second electrical connectors 22 and 24 are mated, and 2) increase the dimension of the gap 120 along the longitudinal direction L that is disposed between the common ground shield 100 and the ground plate 62 when the first and second electrical connectors 22 and 24 are mated. Furthermore, the shield body 102 can be disposed longitudinally forward, or further from the ground mounting ends 104 than the embodiment illustrated in FIGS. 2A-E, which can 1) increase a portion of the overall open area OA that overlaps the electrical signal contacts 44, for instance at the mating ends 50, when the first and second electrical connectors 22 and 24 are mated, and 2) decrease the longitudinal dimension of the gap 120 that is disposed between the common ground shield 100 and the ground plate 62 when the first and second electrical connectors 22 and 24 are mated.

Moreover, referring now to FIGS. 3A-D, the shield body 102 and the electrical signal contacts 35 are spaced a distance D4 along the lateral direction A. The distance D4 can be sized as desired, and is greater than the distance D3 (see FIG. 2E) in accordance with the illustrated embodiment. For instance, the common ground shield 100 can include a plurality of fingers 126 that extend forward from the shield body 102 along the longitudinal direction L and out from the shield body 102 along the lateral direction A toward the corresponding common column CL. In accordance with the illustrated embodiment, the fingers 126 extend from the first beams 108. The fingers 126 can be integral with the shield body 102 as illustrated, or can be separate from the shield body 102 such that the fingers 126 and the shield body 102 are supported in electrical communication with each other by the connector housing 31. Each of the fingers 126 can be split as illustrated, or can define single solid fingers as desired. It should be appreciated that the ground mating ends 106 can be defined by the fingers 126, such that the fingers 126 are configured to be placed in electrical contact with the ground member 59 of the second electrical connector 24. The transition region 122 between the ground mounting ends 104 and the shield body 102 can extend to a depth along the lateral direction A that is equal to that of the transition region 122 such that the shield body 102 extends substantially parallel to the common column CL.

When the first and second electrical connectors 22 and 24 are mated, the fingers 126 can contact the ground member 59, and in particular the ground plate body 64 of the second electrical connector 24. Alternatively, the fingers 126 can be configured to contact the ground mounting ends 68 of the second electrical connector 24 when the first and second electrical connectors 22 and 24 are mated. It should be appreciated that common ground shield can further include the ribs 124 and the fingers 126 as described above. The ribs 124 can extend laterally from the shield body 202 along the lateral direction A so as to define a depth that is substantially equal to that of the fingers 126 and the transition regions 122 so as to contact the ground member 59, for instance at respective ones of the mounting ends 66, of the second electrical connector 24 when the first and second electrical connectors 22 and 24 are mated.

Thus the electrical connector assembly 20 can include first and second matable crosstalk shields defined by the common ground shield 100 and the ground plate 62, respectively. A first one of the matable crosstalk shields, for instance, the common ground shield 100, includes a first contact finger, such as the finger 126, and the second crosstalk shield can define a second contact finger, such as the finger defined by the ground mating ends 66. The first contact finger, for instance the finger 126, can physically touch the ground plate 62, and the second ground contact finger, for instance as defined by the ground mating end 66, can physically touch the common ground shield 100 when the first and second electrical connectors 22 and 24 are mated to each other.

Alternatively, the depth of the ribs 124 can be less than that of the fingers 126 such that only the fingers 126 establish an electrical connection with the ground member 59 of the second electrical connector 24 when the first and second electrical connectors 22 and 24 are mated. It should be appreciated that the ground mating ends 106 can define any suitable depth in the lateral direction A as desired so as to correspondingly adjust the offset distance D4 of the shield body 102 with respect to the electrical signal contacts 35, and thus the common column CL, in the lateral direction A.

Accordingly, it should be appreciated that a kit of electrical connectors 22 can be configured having different performance characteristics, such as being or having been tuned to reduce crosstalk at different signal frequencies and wavelengths with respect to otherwise identical electrical connectors that include discrete ground contacts instead of the common ground shield 100, and further configured to operate at different impedance levels during operation of the electrical connector 22. For instance, each of the plurality of the electrical connectors 22 can include a different number of windows 110*a-c*, windows 110*a-c* having different areas, a different overall open area OA, and the shield body can be differently positioned relative to the signal contacts 35. For instance, the longitudinal position of the shield body 102 can be different, and the offset with respect to the signal contacts 35. In all of these different configurations, it should be appreciated that the position of an open area, for instance an area defined by the windows 110*a-c*, extending through the shield body 102 can differ from connector to connector. The position can differ along a direction substantially parallel to the common column CL of the signal contacts, and along a direction substantially perpendicular to the common column of the signal contacts CL.

The first electrical connector 22 can be referred to as a plug or header connector whose electrical contacts 33 are configured to be received by complementary electrical contacts of the second electrical connector 24, which can be referred to as a receptacle connector. Alternatively, the electrical contacts 33 of the first electrical connector 22 can be configured to receive the complementary electrical contacts of the second electrical connector 24, such that the first electrical connector 22 can be referred to as a receptacle connector and the second electrical connector 24 can be referred to as a header connector. Furthermore, because the mating interface 30 is oriented substantially parallel to the mounting interface 32, the first electrical connector 22 can be referred to as a vertical connector, though it should be appreciated that the first electrical connector can be provided in any desired configuration so as to electrically connect the substrate 28 to the second electrical connector 24. For instance, the first electrical connector 22 can be configured as a right-angle connector, whereby the mating interface 30 is oriented substantially perpendicular to the mounting interface 32.

Referring now to FIGS. 1 and 4A-F, the second electrical connector 24 includes a dielectric or electrically insulative connector housing 42 and a plurality of electrical contacts, which can include electrical signal contacts 44, that are supported by the connector housing 42. In accordance with the illustrated embodiment, the second electrical connector 24 includes a plurality of leadframe assemblies 46 that are supported by the connector housing 42 and arranged along the lateral direction A, which can define the row direction as described above. The plurality of leadframe assemblies 46 can include a first plurality of leadframe assemblies each defining the first contact arrangement, and a second plurality of leadframe assemblies 46 each defining the second contact arrangement. Alternatively, the leadframe assemblies 46 can be identically constructed or first and second pluralities of leadframe assemblies can be arranged in any pattern as desired across the row of leadframe assemblies 46.

Each leadframe assembly 46 can be constructed generally as described in U.S. patent application Ser. No. 12/396,086, filed Mar. 2, 2009, the disclosure of which is hereby incorporated by reference as if set forth in its entirety herein, and can alternatively include an electrically conductive plate such as a ground plate 62 that replaces the discrete ground contacts described in U.S. patent application Ser. No. 12/396,086. Each leadframe assembly 46 thus includes a dielectric leadframe housing 48 and a plurality of electrical signal contacts 44 that are carried by the leadframe housing 48 and arranged along a common column CL. Each leadframe assembly 46 can further include the ground plate 62 that is carried by the respective leadframe housing 48. Any suitable dielectric material, such as air or plastic, may be used to isolate the electrical signal contacts 44 from one another. The leadframe housing 48 of each leadframe assembly 46 defines laterally opposed first and second outer surfaces 58 and 56, respectively The electrical signal contacts 44 define a respective mating ends 50 that extend along the mating interface 34, and opposed mounting ends 52 that extend along the mounting interface 36. Each mating end 50 extends horizontally forward along the longitudinal direction L, and each mounting end 52 extends vertically down along the transverse direction T. The leadframe assemblies 46 are arranged adjacent each other along the lateral direction A.

The mounting ends 52 of the second electrical connector 24 can be constructed similar to the mounting ends 40 of the electrical signal contacts 35 of the first electrical connector 22, and thus may include press-fit tails, surface mount tails, or fusible elements such as solder balls, which are configured to electrically connect to a complementary electrical component such as the substrate 28, which can be configured as a backplane, midplane, daughtercard, or the like. The mating ends 50 are configured to contact and electrically connect to the mating ends 38 of the complementary electrical signal contacts 35 when the first and second electrical connectors 22 and 24 are mated. Each of the electrical signal contacts 44 can define respective first and second opposed broadsides 49 and first and second edges 51 connected between the broadsides 49. The edges 51 define a length less than that of the broadsides 49, such that the electrical signal contacts 44 define a rectangular cross section.

The mating end 50 of each signal contact 44 can include a neck 37 that extends out from the leadframe housing 48 along a longitudinally forward direction. The neck 37 can be laterally curved in a direction toward the outer surface 58 of the leadframe housing 48, so as to be generally aligned with corresponding mating ends 66 of the ground plate 62. Each signal contact 44 can further include a pair of transversely split fingers 43 that extend longitudinally outward, or forward, from the neck 37. The split fingers 43 can be curved and configured to mate with the mating ends 38 of the electrical signal contacts 35 of the first electrical connector 22. The split fingers 43 can be flexible, and can flex when mated with the mating ends 38 so as to provide a normal force against the mating ends 38.

The mounting end 52 of each signal contact 44 can define a neck 53 that extends transversely down from the leadframe housing 48, and a mounting terminal 55 that extends down from the neck 53. The neck 53 and/or the mounting terminal 55 can be angled or curved toward the outer surface 58, and thus toward the ground plate 62. The mounting terminal 55 can define an eye-of-the-needle or any suitable alternative shape configured to electrically connect to the substrate 26. For instance, the mounting terminals 55 can be pressed into vias that extend into the substrate 26 so as to be placed in electrical communication with electrical traces that run along or through the substrate 26.

The electrical signal contacts 44 may define a lateral material thickness of about 0.1 mm to 0.5 mm and a transverse height of about 0.1 mm to 0.9 mm. The contact height may vary over the length of the right angle electrical signal contacts 44. The electrical contacts 44 can be spaced apart at any distance as desired, as described in U.S. patent application Ser. No. 12/396,086. The second electrical connector 24 also may include an IMLA organizer 54 that may be electrically insulated or electrically conductive, and retains the IMLAs or lead frame assemblies 46.

At least one or more pairs of adjacent electrical signal contacts 44 can be configured as differential signal pairs 45. In accordance with one embodiment, the differential signal pairs 45 are edge coupled, that is the edges 51 of each electrical contact 44 of a given differential pair 45 face each other along a common transverse column CL. Thus, the electrical connector 22 can include a plurality of differential signal pairs 45 arranged along a given column CL. As illustrated, the electrical connector 22 can include four differential signal pairs 45 positioned edge-to-edge along the column CL, though the electrical connector 24 can include any number of differential signal pairs along a given centerline as desired, such as two, three, four, five, six, or more differential signal pairs.

Because the mating ends 50 and the mounting ends 52 are substantially perpendicular to each other, the electrical signal contacts 44 can be referred to as right-angle electrical contacts. Similarly, because the mating interface 30 is substantially parallel to the mounting interface 32, the first electrical connector 22 can be provided as a vertical header connector. Moreover, because the mating ends 50 are configured to receive the mating ends 38 of the complementary electrical signal contacts 35 configured as plugs, the electrical signal contacts 44 of the second electrical connector 24 can be referred to as receptacle contacts. It should be appreciated, however, that the second electrical connector 24 can be provided in any desired configuration so as to electrically connect the substrate 28 to the first electrical connector 22. For instance, the second electrical connector 24 can be configured as a header connector, and can be further be configured as a vertical connector as desired. When the first and second connectors 22 and 24 are mounted to their respective substrates 26 and 28 and mated with each other, the substrates 26 and 28 are placed in electrical communication.

The first and second electrical connectors 22 and 24 may be shieldless high-speed electrical connectors, i.e., connectors that operate without metallic crosstalk plates between adjacent columns of electrical contacts, and can transmit electrical signals across differential pairs at data transfer rates at or above four Gigabits/sec, and typically anywhere at or between 6.25 through 12.5 Gigabits/sec or more (about 80 through 35 picosecond rise times) with acceptable worst-case, multi-active crosstalk on a victim pair of no more than six percent. Worst case, multi-active crosstalk may be determined by the sum of the absolute values of six or eight aggressor differential signal pairs that are closest to the victim differential signal pair, as described in U.S. Pat. No. 7,497, 736. Each differential signal pair may have a differential impedance of approximately 85 to 100 Ohms, plus or minus 10 percent. The differential impedance may be matched, for instance, to the respective substrates 26 and 28 to which the first and second electrical connectors 22 and 24 may be attached. The first and second connectors 22 and 24 may have an insertion loss of approximately −1 dB or less up to about a five-Gigahertz operating frequency and of approximately −2 dB or less up to about a ten-Gigahertz operating frequency.

With continuing reference to FIGS. 4A-4F, the leadframe housing 48 of each leadframe assembly 46 defines laterally opposed first and second outer surfaces 58 and 56, respectively. The leadframe housing 48 can be made of any suitable dielectric material such as plastic, and carries the right-angle electrical signal contacts 44. The leadframe assemblies 46 can be configured as insert molded leadframe assemblies (IMLAs), whereby the electrical signal contacts 44 are overmolded by the leadframe housing 48 in accordance with the illustrated embodiment. Alternatively, the electrical signal contacts 44 of the leadframe assemblies 46 can be stitched or otherwise attached in the leadframe housing 48. Each electrical signal contact 44 defines a mating end 50 and a mounting end 52 as described above. The mating ends 50 are aligned along the transverse direction T, and the mounting ends 52 are aligned along the longitudinal direction L. The signal contacts 44 are arranged in pairs, which can be differential signal pairs 45. Alternatively, the signal contacts 44 can be provided as single-ended signal contacts. Selected ones of the signal contacts 44, such as one or more up to all of adjacent pairs 45 of signal contacts 44, are separated by a gap 60. The electrical signal contacts 44 are further disposed in the leadframe housing 48 such that the gap 60 spaces the upper one of the electrical signal contacts 44 from the upper end of the leadframe assembly 46.

Each leadframe assembly 46 further includes a ground member 59 that can be configured as a ground plate 62 in accordance with the illustrated embodiment, or can alternatively be configured as individual electrical ground contacts that are carried by the leadframe housings 48 and disposed adjacent electrical signal contacts 44 of the second electrical connector 24, such as adjacent differential signal pairs defined by the electrical signal contacts 44. In accordance with the illustrated embodiment, each of the ground plates 62 is carried by a respective one of the leadframe housings 48. The ground plate 62 defines ground mating ends 66 that are configured to mate with complementary ground contacts of the electrical connector 22, and opposed ground mounting ends 68 that are configured to connect to the substrate 26.

The ground mounting ends 68 can extend out along the longitudinal direction L a distance greater than the mounting ends 52 of the electrical signal contacts 44 as illustrated, or can extend out a distance substantially equal to the mating ends 50 of the electrical signal contacts 44 as desired. The ground plate 62 defines a plurality of gaps 79 disposed between adjacent mating ends 66. The ground plate 62 is further configured to provide an electrical shield between differential signal pairs 45 of adjacent columns CL. The ground plate 62 can be formed from any suitable electrically conductive material, such as a metal, and includes a body 64, a plurality of mating ends 66 extending forward from the body 64, and a plurality of mounting ends 68 extending down from the body. The ground mating ends 66 and mounting ends 68 can be constructed as described above with respect to the mating ends 50 and mounting ends 52 of the electrical signal contacts 44. The ground plate 62 of each leadframe assembly 46 can be discretely attached to the leadframe housing 48 or overmolded by the leadframe housing 48 of the respective leadframe assembly 46. For instance, the ground plate 62 can include a latch 89 (see FIG. 1) that extends from the ground plate body 64 and is configured to engage the leadframe housing 48 so as to secure the ground plate 62 to the leadframe housing 48.

With continuing reference to FIGS. 4A-F, each ground mating end 66 of the ground plate 62 can be configured as a finger that extends out from the body 64 along the lateral direction A and the longitudinal direction L. For instance, the ground mating ends 66 can include respective necks 61 that extends longitudinally forward from the body 64. The neck 61 can be laterally curved in a direction toward the signal contacts 44 of the leadframe assembly 46, such that the ground mating ends 66 are generally aligned with the corresponding mating ends 50 of the signal contacts 44. Accordingly, the ground mating ends 66 are configured to mate with the ground mating ends 106 of the complementary first electrical connector 22. Each mating end 66 of the ground plate 62 can further include a pair of transversely split fingers including a first or upper finger 63*a* and a second or lower finger 63*b* that each extends longitudinally forward, from the neck 61. The fingers 63*a* and 63*b* can be curved and configured to mate with the mating ends 38 of the electrical contacts 35. The fingers 63*a* and 63*b* can be flexible so as to flex when mated with the mating ends 38 so as to provide a normal force. The fingers 63*a* and 63*b* can extend further longitudinally forward than the fingers 43 of the electrical signal contacts 44. Each mating end 66 extends out from the ground plate body 64 and defines opposed distal tips of each of the fingers 63*a* and 63*b*.

Each mounting end 52 of the ground plate 62 can define a neck 67 that extends transversely down from the body 64, and a mounting terminal 69 that extends down from the neck 67. The neck 67 and/or the mounting terminal 69 can be angled or curved toward the electrical contacts 44. The mounting terminals 69 can define an eye-of-the-needle or any suitable alternative shape configured to electrically connect to the substrate 26. For instance, the mounting terminals 69 can be pressed into vias that extend into the substrate 26 so as to be placed in electrical communication with electrical traces that run along or through the substrate 26.

The body 64 of the ground plate 62 defines a first outer surface 72 and a second outer surface 70 that is laterally opposed with respect to the first outer surface 72. The second outer surface 70 can be flush with, can protrude past, or can be inwardly recessed with respect to the corresponding outer surface 58 of the leadframe housing 48. Accordingly, the dimensions of the electrical connector 24 can remain unchanged with respect to electrical connectors whose IMLAs carry discrete ground contacts, for instance as described in U.S. Pat. No. 7,497,736, the disclosure of which is hereby incorporated by reference as if set forth in its entirety herein. The first outer surface 72 faces the electrical signal contacts 44 of the leadframe assembly 46. The ground plate 62 can include an engagement member, such as a first lip 65*a* that fits into a slot that extends laterally into the outer surface 58 of the leadframe housing 48, and a second lip 65*b* that fits over the leadframe housing 48 so as to capture the leadframe housing 48 and the ground plate 62.

The ground plate 62 can be electrically conductive. For example, the ground plate could be a stamped metal crosstalk shield and thus reflect electromagnetic energy produced by the signal contacts 44 during use. It should be appreciated that the ground plate 62 could alternatively be configured to absorb electromagnetic energy. For example, the ground plate 62 can be made from one or more electrically conductive magnetic absorbing materials, such as ECCOSORB® absorber products commercially available from Emerson &

Cuming, located in Randolph, Mass. The ground plate 62 can alternatively be made from one or more SRC PolyIron® absorber products, commercially available from SRC Cables, Inc, located in Santa Rosa, Ca. Furthermore, because the ground plates 62 are disposed between the signal contacts 44 of adjacent leadframe assemblies 46, the ground plates 62 can provide a shield between differential signal pairs 45 of adjacent columns CL that reduces cross-talk between the signal contacts 44 of adjacent leadframe assemblies 46.

The ground mating ends 66 of the ground plate 62 are aligned along the transverse direction T, and are further aligned with the mating ends 58 of the signal contacts 44 along the transverse direction T. The ground mating ends 66 of the ground plate 62 can be longitudinally outwardly offset with respect to the mating ends 58 of the signal contacts 44. The ground mounting ends 68 are aligned along the longitudinal direction L, and are aligned with the mounting ends 52 along the longitudinal direction L. The ground mating ends 66 are positioned adjacent and/or between adjacent pairs of the mating ends 50 of the signal contacts, and the ground mounting ends 68 are positioned adjacent and/or between pairs of mounting ends 52. Thus, the mating interface 34 of the electrical connector 24 includes both the mating ends 50 of the electrical signal contacts 44 and the ground mating ends 66 of the ground plate 62, and the mounting interface 36 of the electrical connector 24 includes both the mounting ends 52 of the electrical signal contacts 44 and the mounting ends 66 of the ground plate 62.

In accordance with the illustrated embodiment, when the ground plate 62 is attached to the leadframe housing 48, the ground mating ends 66 are disposed between a pair of mating ends 50 of adjacent electrical signal contacts 44. The ground mating ends 66 can thus be disposed in the gap 60 between the mating ends 50 of adjacent differential signal pairs 45, such that the mating ends 50 and 66 are equidistantly spaced along the mating interface 34 of the electrical connector 24. Likewise, the ground mounting ends 68 of the ground plate 62 are disposed in the gap 60 that extends between them mounting ends 52 of adjacent signal pairs 45, such that the ground mounting ends 68 and 52 are equidistantly spaced along the mounting interface 36 of the electrical connector 24.

The plurality of leadframe assemblies 46 can be constructed identically, and configured such that when the ground plate 62 is attached to the leadframe housing 48, the mating interface 34 of at least one up to all of the leadframe assemblies 46 are arranged in a first pattern of mating ends 50 and 66. In accordance with the illustrated embodiment, the first contact arrangement is a repeating G-S-S pattern, whereby "G" identifies one of the mating ends 66 the ground plate 62, and "S" identifies one of the mating ends 50 of an electrical signal contact 44, and the two adjacent "S"s in the repeating G-S-S can identify a differential signal pair 45. Because the mating ends 66 and 50 are arranged in a repeating G-S-S pattern from the top of the mating interface 34 in a downward direction toward the mounting interface 36 along the respective column CL, the IMLA 26*a* and corresponding mating ends 50 and 66 can be said to define a repeating G-S-S pattern. The mounting ends 52 and 68 are therefore likewise arranged in the repeating G-S-S pattern from the rear end of the leadframe assembly 46 in a longitudinal direction toward the front end, or mating interface 34, of the leadframe assembly 46.

Referring now to FIGS. 4A-F, the ground plate 62 can include at least one rib 74, such as a plurality of ribs 74 supported by the plate body 64. The ribs 74 can be constructed as described in U.S. patent application Ser. No. 12/722,797, the disclosure of which is incorporated by reference as if set forth in its entirety herein. In accordance with the illustrated embodiment, each rib 74 is stamped or embossed into the body 64, and is thus integral with the body 64. Thus, the ribs 74 can further be referred to as embossments. As illustrated, each rib 74 defines a first surface 75 that defines a projection 76 that extends laterally inwardly (e.g., into the leadframe housing 48 of the leadframe assembly 46) from the outer surface 72, and an opposed second surface 77 that defines a corresponding embossment 78 or recessed surface that extends into the outer surface 70 of the ground plate body 64. Otherwise stated, the body 64 includes a plurality of projections 76 projecting laterally from the outer surface 72, and further includes a plurality of embossments 78, corresponding to the plurality of projections 76, recessed in the outer surface 70. The projections 76 can extend inward to a depth so as to be aligned with the electrical signal contacts 44 that are carried by the leadframe housing 48. The ribs 74 are positioned so as to be disposed equidistantly between adjacent differential signal pairs 45 inside the leadframe housing. The ribs 74 define respective enclosed outer perimeters 80 that are spaced from each other along the ground plate body 64. Thus, the ribs 74 are fully contained in the plate body 64. The common ground shield 100 can be positioned such that the ribs 124 project from the shield body 102 along a direction that is opposite the direction in which the ribs 74 project from the plate body 64.

The ground plate 64 can be retained by the leadframe housing 48 at a position such that the ground mating ends 66 of the ground plate 64 are be disposed between the mating ends 50 of adjacent differential signal pairs 45. The ground plates 62 can be inserted into the leadframe housing 48, overmolded by the leadframe housing 48, or otherwise carried or retained by the leadframe housing 48 such that the dimensions of the leadframe assembly 48 are substantially equal to those of conventional leadframe assemblies that contain discrete signal contacts and ground contacts overmolded by or otherwise coupled to a leadframe housing. The ground plate body 64 spans across a portion of a plurality up to all of the differential signal pairs 45 that is disposed in the leadframe housing 48. The leadframe assemblies 46 do not include discrete ground contacts, but rather includes the ground plate 62 that provides a low-impedance common path to intercept and dissipate stray electro-magnetic energy that otherwise would have been a source for cross talk between the electrical signal contacts 44 of adjacent leadframe assemblies 48. The ground plate 62 can be configured to reflect electromagnetic energy produced by the signal contacts 44 during use, though it should be appreciated that the plate could alternatively be configured to absorb electromagnetic energy. For instance, the ground plates 62 can be made of any lossy material, conductive or nonconductive.

A method can be provided to improve the electrical performance of an electrical connector. The method can include the step of sizing windows, such as at least one of the windows 110*a-c* up to all of the windows 110*a-c* in a crosstalk shield, such as the common ground shield 100, to simultaneously raise or lower measured differential impedance and lower measured near-end crosstalk, lower measured far-end crosstalk, or lower both measured near-end crosstalk and measured far-end crosstalk.

It should be noted that the illustrations and discussions of the embodiments shown in the figures are for exemplary purposes only, and should not be construed limiting the disclosure. One skilled in the art will appreciate that the present disclosure contemplates various embodiments. It should be further appreciated that the features and structures described and illustrated in accordance one embodiment can apply to all embodiments as described herein, unless otherwise indicated. Additionally, it should be understood that the concepts described above with the above-described embodiments may be employed alone or in combination with any of the other embodiments described above.

What is claimed:

1. An electrical connector defining a mounting interface configured to electrically connect to a substrate, and a mating interface configured to electrically connect to a second electrical connector, the electrical connector comprising:

an electrically conductive common ground shield configured to be at least partially disposed at the mating interface, the common ground shield comprising a shield body that is oriented substantially along a plane that is defined by a longitudinal direction and a transverse direction that is perpendicular to the longitudinal direction, the common ground shield defining 1) a plurality of ground mounting ends that extend from the shield body, 2) a plurality of ground mating ends that extend from the shield body, are spaced from each other along the transverse direction, and are spaced from the plane along a select direction normal to the plane, and 3) a plurality of enclosed windows that extend therethrough along the select direction; and a plurality of electrical signal contacts each having a portion that is disposed adjacent the ground shield and spaced from the ground shield along the select direction, wherein the portion of each of the electrical signal contacts is aligned with a respective one of the windows along the select direction, and the electrical signal contacts each defines a mating end that is disposed beyond the windows in the longitudinal direction.

2. The electrical connector as recited in claim 1, wherein an entirety of each of the electrical signal contacts is planar where the signal contacts are aligned with the respective one of the windows with respect to the select direction.

3. The electrical connector as recited in claim 1, wherein each of the ground mating ends comprises a pair of split fingers.

4. The electrical connector as recited in claim 1, wherein at least one of the windows is disposed between adjacent ones of the ground mating ends with respect to the transverse direction, the adjacent ones of the ground mating ends being adjacent each other along the transverse direction.

5. The electrical connector as recited in claim 1, wherein the ground mounting ends are coplanar with the ground mating ends along a plane that is parallel with the plane of the shield body.

6. The electrical connector as recited in claim 1, wherein pairs of the electrical signal contacts each define a portion that is aligned with a respective one of the plurality of windows along the select direction.

7. The electrical connector as recited in claim 6, wherein the pairs of the mating ends of the electrical signal contacts are disposed between respective ones of the ground mating ends with respect to the transverse direction.

8. The electrical connector as recited in claim 7, wherein the mating ends of the electrical signal contacts are spaced from each other along the transverse direction.

9. The electrical connector as recited in claim 7, wherein the ground shield further comprises a plurality of ribs embossed in the shield body and spaced from each other along the transverse direction, each of the ribs aligned with a respective one of the ground mounting ends along the longitudinal direction, and each of the ribs is aligned with each of the plurality of electrical signal contacts along the transverse direction.

10. The electrical connector as recited in claim 7, wherein respective terminal ends of the ground mating ends are coplanar with respective terminal ends of the mating ends of the electrical signal contacts along a plane that is parallel to the plane of the shield body.

11. The electrical connector as recited in claim 10, wherein respective portions of the ground mating ends extend in the select direction as they extend along a direction away from the shield body, such that the terminal ends of the ground mating ends are coplanar with the respective terminal ends of the mating ends of the electrical signal contacts.

12. An electrical connector comprising:

an electrically conductive common ground shield including a shield body that is oriented substantially along a plane that is defined by a longitudinal direction and a transverse direction that is perpendicular to the longitudinal direction, the common ground shield defining 1) a plurality of ground mounting ends that extend from the shield body, 2) a plurality of ground mating ends that extend from the shield body, are spaced from one another along the transverse direction, and are spaced from the plane along a lateral direction that is perpendicular to both the longitudinal direction and the transverse direction, and 3) a plurality of enclosed windows that extend therethrough along the lateral direction; and a plurality of electrical signal contacts that define mating ends that are disposed between respective adjacent ones of the ground mating ends with respect to the transverse direction, wherein 1) a respective portion of each of the plurality of electrical signal contacts is spaced from the shield body along the lateral direction and is aligned with one of the plurality of the windows along the lateral direction, and 2) the mating ends of the electrical signal contacts are disposed beyond the windows in the longitudinal direction, wherein one of the windows is disposed between the respective adjacent ones of the ground mating ends with respect to the transverse direction, the adjacent ones of the ground mating ends being adjacent each other along the transverse direction.

13. The electrical connector as recited in claim 12, wherein the electrical signal contacts are arranged in a plurality of differential signal pairs, and the mating ends of the electrical contacts of each of the plurality of differential signal pairs are disposed between adjacent ones of the ground mating ends with respect to the transverse direction.

14. The electrical connector as recited in claim 12, wherein an entirety of each of the electrical signal contacts is planar where they are aligned with the one of the windows along the lateral direction.

15. The electrical connector as recited in claim 12, wherein the ground mating ends are arranged along a mating interface, the ground mounting ends are arranged along a mounting interface, and the mating interface is oriented parallel to the mounting interface.

16. The electrical connector as recited in claim 12, wherein each of the ground mating ends comprises a pair of split fingers.

17. The electrical connector as recited in claim 12, wherein the ground shield is metallic.

18. The electrical connector as recited in claim 12, wherein the ground mounting ends are coplanar with the ground mating ends along a plane that is parallel with the plane of the shield body.

19. The electrical connector as recited in claim 12, wherein respective terminal ends of the ground mating ends are coplanar with respective terminal ends of the mating ends of the electrical signal contacts along a plane that is parallel to the plane of the shield body.

20. The electrical connector as recited in claim 19, wherein respective portions of the ground mating ends extend in the lateral direction as they extend along the longitudinal direction away from the shield body, so as to bring terminal ends of the ground mating ends in plane with the mating ends of the electrical signal contacts.

* * * * *